US007416354B2

(12) United States Patent
Kaneko et al.

(10) Patent No.: US 7,416,354 B2
(45) Date of Patent: Aug. 26, 2008

(54) SHEET CUTTING DEVICE, SHEET FINISHER EQUIPPED THEREWITH, AND IMAGE FORMING SYSTEM PROVIDED THEREWITH

(75) Inventors: Masahiro Kaneko, Hino (JP); Toshio Shida, Higashiyamato (JP); Hiroyuki Wakabayashi, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 465 days.

(21) Appl. No.: 11/135,582

(22) Filed: May 23, 2005

(65) Prior Publication Data

US 2006/0065090 A1 Mar. 30, 2006

(30) Foreign Application Priority Data

Sep. 27, 2004 (JP) ..... 2004-279016

(51) Int. Cl.

| | |
|---|---|
| ***B41J 11/70*** | (2006.01) |
| ***B26D 1/08*** | (2006.01) |
| ***B26D 7/18*** | (2006.01) |
| ***B65H 35/04*** | (2006.01) |

(52) U.S. Cl. ..... 400/621; 399/407; 83/98; 83/167

(58) Field of Classification Search ..... None
See application file for complete search history.

(56) References Cited

U.S. PATENT DOCUMENTS

| | | | | |
|---|---|---|---|---|
| 5,379,668 | A * | 1/1995 | Standing | 83/99 |
| 6,520,058 | B2 * | 2/2003 | Nakajima et al. | 83/206 |

FOREIGN PATENT DOCUMENTS

| | | | |
|---|---|---|---|
| JP | 09128655 | A * | 5/1997 |
| JP | 2000335028 | A * | 12/2000 |
| JP | 2003-136471 | | 5/2003 |
| JP | 2003-260834 | | 9/2003 |
| JP | 2004114197 | A * | 4/2004 |

* cited by examiner

*Primary Examiner*—Daniel J Colilla
(74) *Attorney, Agent, or Firm*—Cantor Colburn LLP

(57) ABSTRACT

A sheet cutting apparatus includes: a cutting blade for cutting a sheet; an inserting device for inserting the sheet into a cutting position to be cut by the cutting blade; a taking out device for taking out the sheet from the cutting position after the sheet has been cut by the cutting blade; and an airflow generating device provided downstream of the cutting position in a direction of taking out the sheet by the taking out device for supplying an airflow to the cutting position.

8 Claims, 8 Drawing Sheets

SHEET CUTTING DEVICE, SHEET FINISHER EQUIPPED THEREWITH, AND IMAGE FORMING SYSTEM PROVIDED THEREWITH

This application claims priority from Japanese Patent Application No. 2004-279016 filed on Sep. 27, 2004, which is incorporated hereinto by reference.

BACKGROUND OF THE INVENTION

The present invention relates to a sheet cutting device that cut several sheets of paper, to a sheet finisher equipped with the sheet cutting device, and to an image forming system provided with the sheet cutting device.

A sheet finisher carrying out various types of post-processing (finishing) is connected to a high speed image forming apparatus such as an image forming apparatus employing the electro-photography method, and a multiple-function image forming system has come into wide use that make it possible to carry out within a single apparatus various types of finishing operations such as punching, stapling, and folding of paper sheets on which images have been formed.

A sheet finisher is available that include a sheet cutting device for aligning and cutting the edges of stacks of sheets having a plurality of sheets after carrying out various types of finishing operations such as hole punching, stapling, folding, etc., and the following types of devices are known as sheet cutting devices.

In other words, a cutting device for cutting a plurality of sheets of paper stacked one on top of the other on a table, in which the stack of paper sheets is cut by a cutter that rises from below in a diagonally upward direction while the stack of sheets is being kept pressed by a sheet pressing member that comes down from above the sheets while being guided by vertical guides, and the sheet pressing member and the cutter are each provided with a separate motor whose rotation is transmitted to a screw, the nut engaging with that screw is coupled by a link to the sheet pressing member or the cutter, thereby making it possible to drive them using even a small motor. (See, for example, Patent Document 1.)

Patent Document 1: Japanese Non-Examined Patent Publication No. 2003-136471.

In the configuration disclosed in Patent Document 1, size reduction of the apparatus is being aimed at because the drive can be realized using small motors and the apparatus can be used as a peripheral device of office equipment used in offices with limited installation space. However, the paper shreds generated at the time of cutting may not drop down but may get adhered to the table or to the paper pressing member. Because, the static electricity generate while carrying out the different processes of punching, stapling, folding, etc., or the static electricity generate due to the friction between the table and the sheet pressing member at the time of insertion into the cutting section, or the static electricity generate at the time of cutting.

If the cutting operation is carried out with the paper shreds adhering to the table or to the paper pressing member, the paper shreds leave their marks on the stack of sheets because the force of pressing the stack of sheets is large, and hence the finishing quality will be lost. Further, because of the adhered paper shreds, when a new stack of sheets is inserted into the cutting section, the outer sheets in a stack of sheets may get slightly shifted or may get folded.

SUMMARY OF THE INVENTION

In view of the above problems, an object of the present invention is to provide a sheet cutting device that does not affect the finishing quality of the sheet bundle at the time of cutting the sheet bundle, and that also makes it possible to carry out the cutting process in a stable manner.

The object of the present invention can be achieved by any one of the following structures (1) to (3).

(1) A sheet cutting apparatus comprising:

(a) a cutting blade for cutting a sheet;

(b) an inserting device for inserting the sheet into a cutting position to be cut by the cutting blade;

(c) a taking out device for taking out the sheet from the cutting position after the sheet has been cut by the cutting blade; and (d) an airflow generating device provided downstream of the cutting position in a direction of taking out the sheet by the taking out device for supplying an airflow to the cutting position.

(2) A sheet finishing apparatus for finishing a sheet received from an outside, comprising the sheet cutting apparatus described in (1) for cutting a sheet that the sheet finishing apparatus has received.

(3) An image forming system comprising:

(a) an image forming apparatus for recording an image on a recording sheet; and (b) the sheet cutting apparatus described in (1) for cutting the recording sheet on which the image has been recorded by the image forming apparatus.

DETAILED DESCRIPTION OF THE PREFERRED EMBODIMENT

In the following, an example of the preferred embodiments of the sheet finishing apparatus according to the present invention is described with reference to the drawings.

The sheet cutting device according to the present preferred embodiment is configured as a part of a sheet finishing apparatus, the sheet finishing apparatus is coupled to an image forming apparatus, thereby forming on the whole an image forming system.

Figure 1:
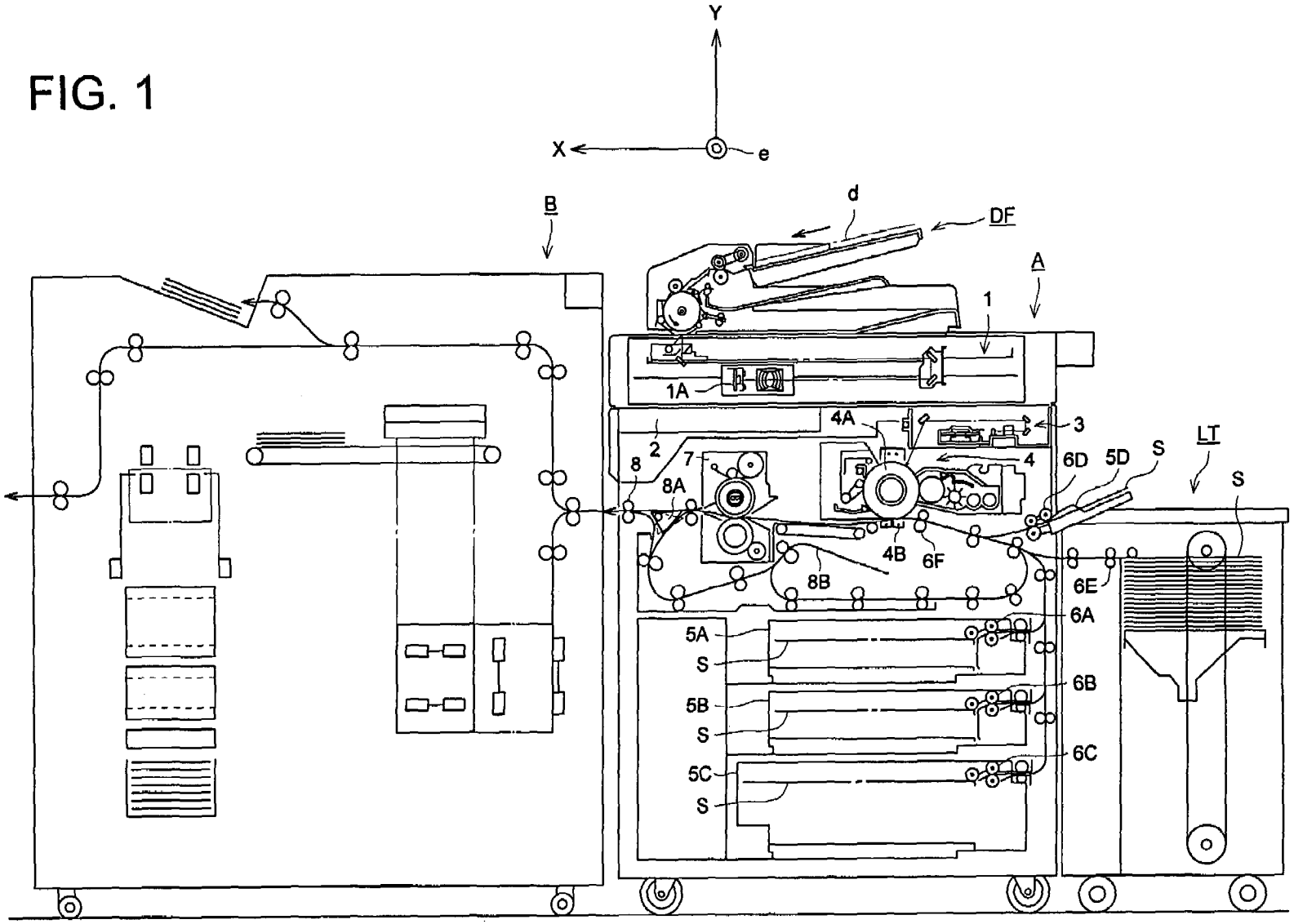
FIG. 1 is an overall configuration diagram of an image forming apparatus provided with a sheet finishing apparatus.

FIG. 1 is an overall configuration diagram of an image forming apparatus provided with a sheet finishing apparatus.

Here, A is an image forming apparatus, DF is an automatic document feeder, LT is a large quantity sheet feeding device, and B is a sheet finishing apparatus.

The image forming apparatus A is provided with an image reading section (image input device) 1, an image processing section 2, an image writing section 3, an image forming section 4, sheet feeding cassettes 5A, 5B, and 5C, and a manual sheet feeding tray 5D, the first sheet feeding sections 6A, 6B, 6C, 6D, 6E, registration roller 6F, a fixing apparatus 7, a sheet discharging section 8, and an automatic double-sided copying sheet feeding unit (ADU) 8B, etc.

The automatic document feeder DF is placed above the image forming apparatus A and, the sheet finishing apparatus B is coupled to the image feeding apparatus in an integrated manner on the left side surface in the drawing.

The document 'd' stacked on the document table of the automatic document feeder DF is transported in the direction of the arrow, and the images on one or both sides of the document are read out by the image sensor CCD 1A of the optical system of the image reading section 1.

The analog signal obtained by photoelectric conversion by the image sensor CCD 1A is first subjected to analog signal processing, A/D conversion, shading correction, image compression, etc., in the image processing section 2, and is sent as the image information signal to the image writing section 3.

The image forming section 4 is a part that forms the image using an electro-photographic process, and carries out the processes of charging, exposure, development, image transfer, image separation, and cleaning, etc., on the photosensitive drum 4A. During the exposure process, the photosensitive drum 4A is exposed to the light output from the semiconductor laser (not shown in the drawing) based on the image information signal, thereby forming an electrostatic latent image. In addition, during the development processing, a toner image corresponding to the electrostatic latent image is formed on the photosensitive drum 4A.

When any one selected among a plurality of sheet feeding cassettes 5A, 5B, and 5C, the manual sheet feeding tray 5D, the first sheet feeding sections 6A to 6E, the sheet S is transported towards the registration roller 6F. Synchronization between the sheet S and the toner image on the photosensitive drum 4A is achieved by the registration roller 6F, and the sheet S is transported towards the image transfer unit 4B and the toner image is transferred onto the sheet S.

The sheet S carrying the toner image is fixed in the fixing unit 7, and is sent from the sheet discharging section 8 to the sheet finishing apparatus B.

When image forming is done on both sides of the sheet, the sheet S with image formed on one surface is sent to the automatic double-sided copying sheet feeding section 8B by the transport path selection plate 8A, image formation is done on the other surface of the sheet, the toner image is fixed by the fixing unit 7, and the sheet is sent from the sheet discharging section 8 to the sheet finishing apparatus B.

Next, an outline description of the sheet finishing apparatus B is given below referring to FIG. 2, FIG. 3, FIG. 4, and FIG. 5.

Figure 2:
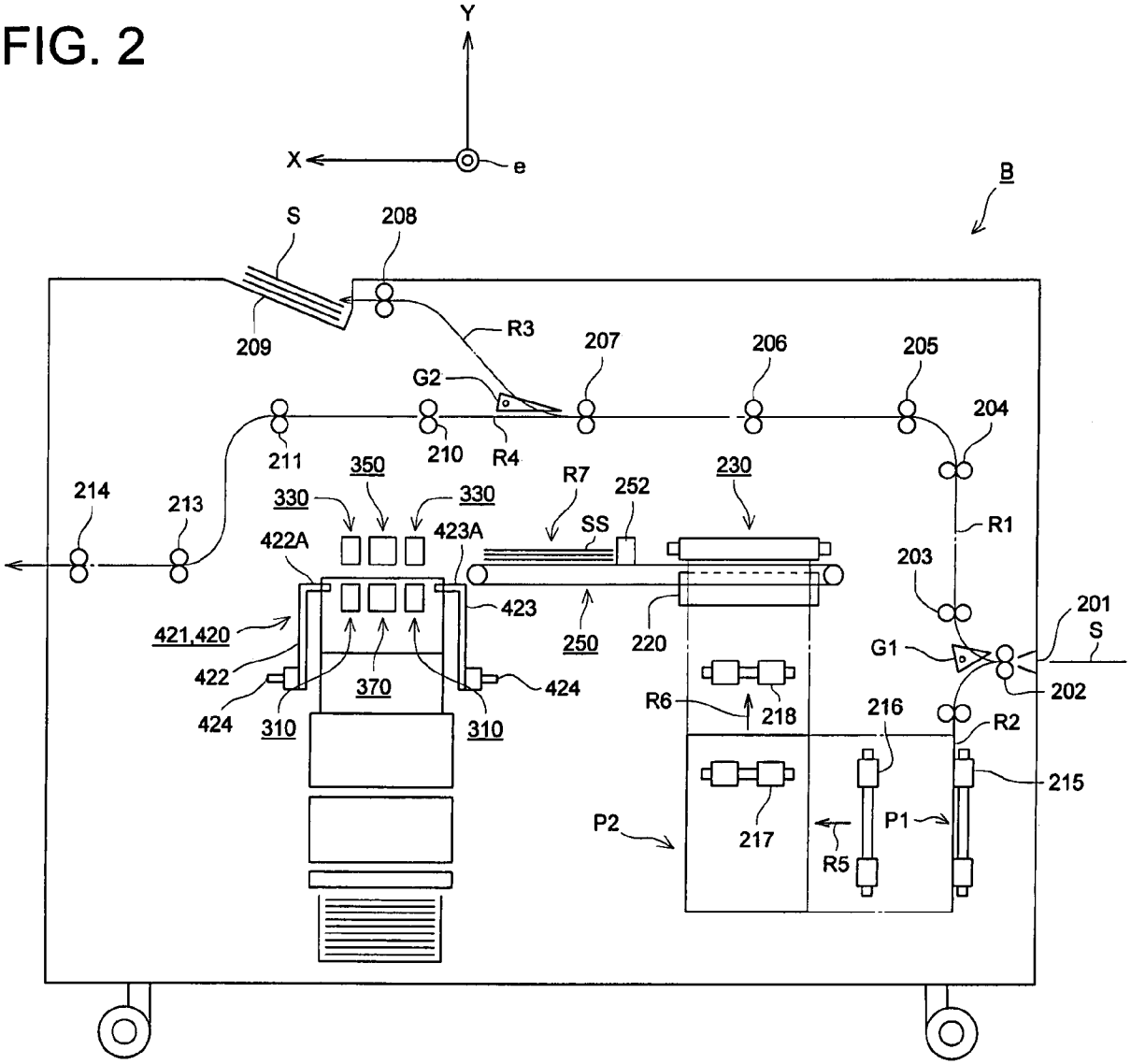
FIG. 2 is an outline front view diagram of a sheet finishing apparatus.
Figure 3:
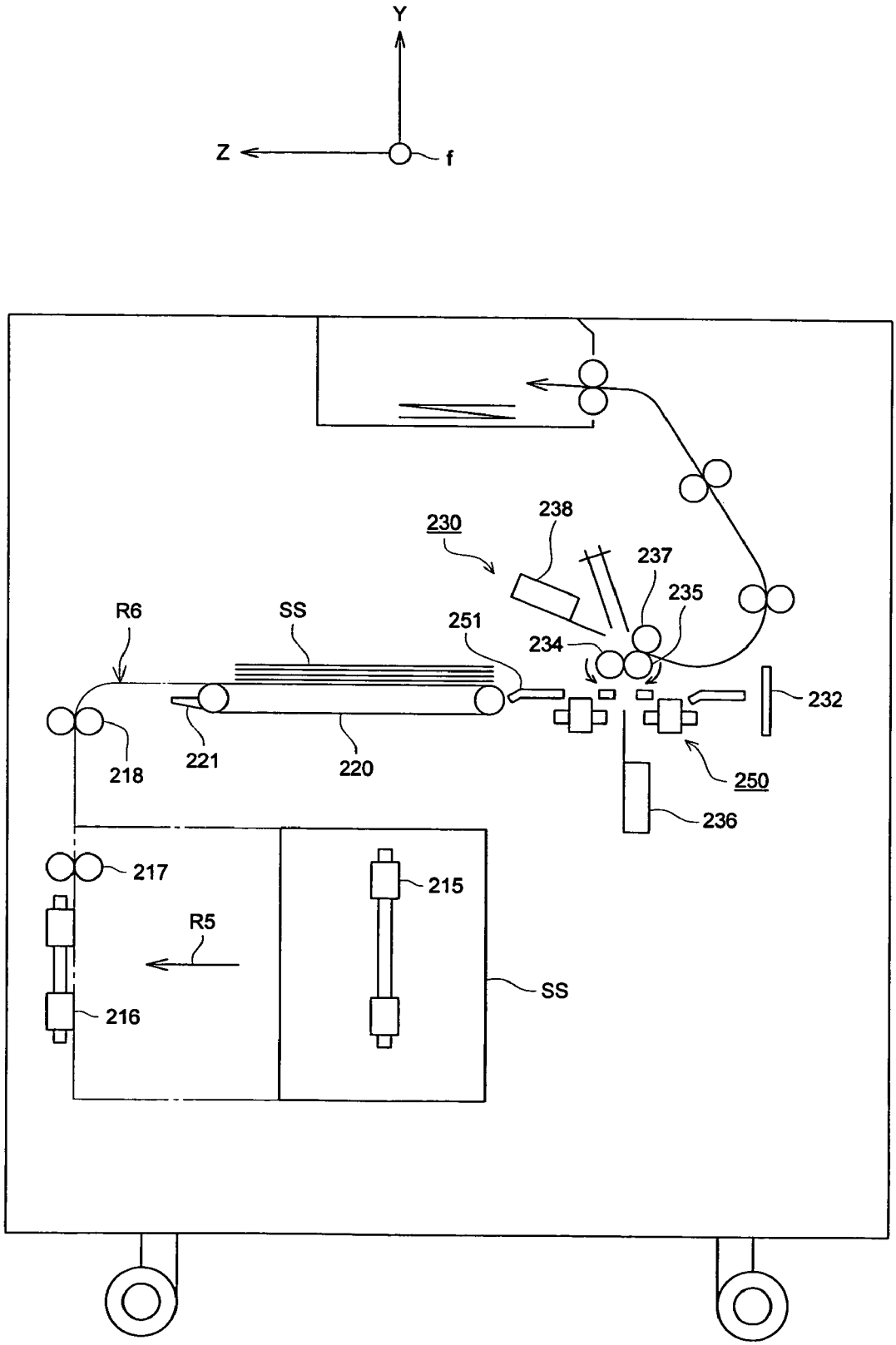
FIG. 3 is the right side view of the sheet finishing apparatus of FIG. 2.
Figure 4:
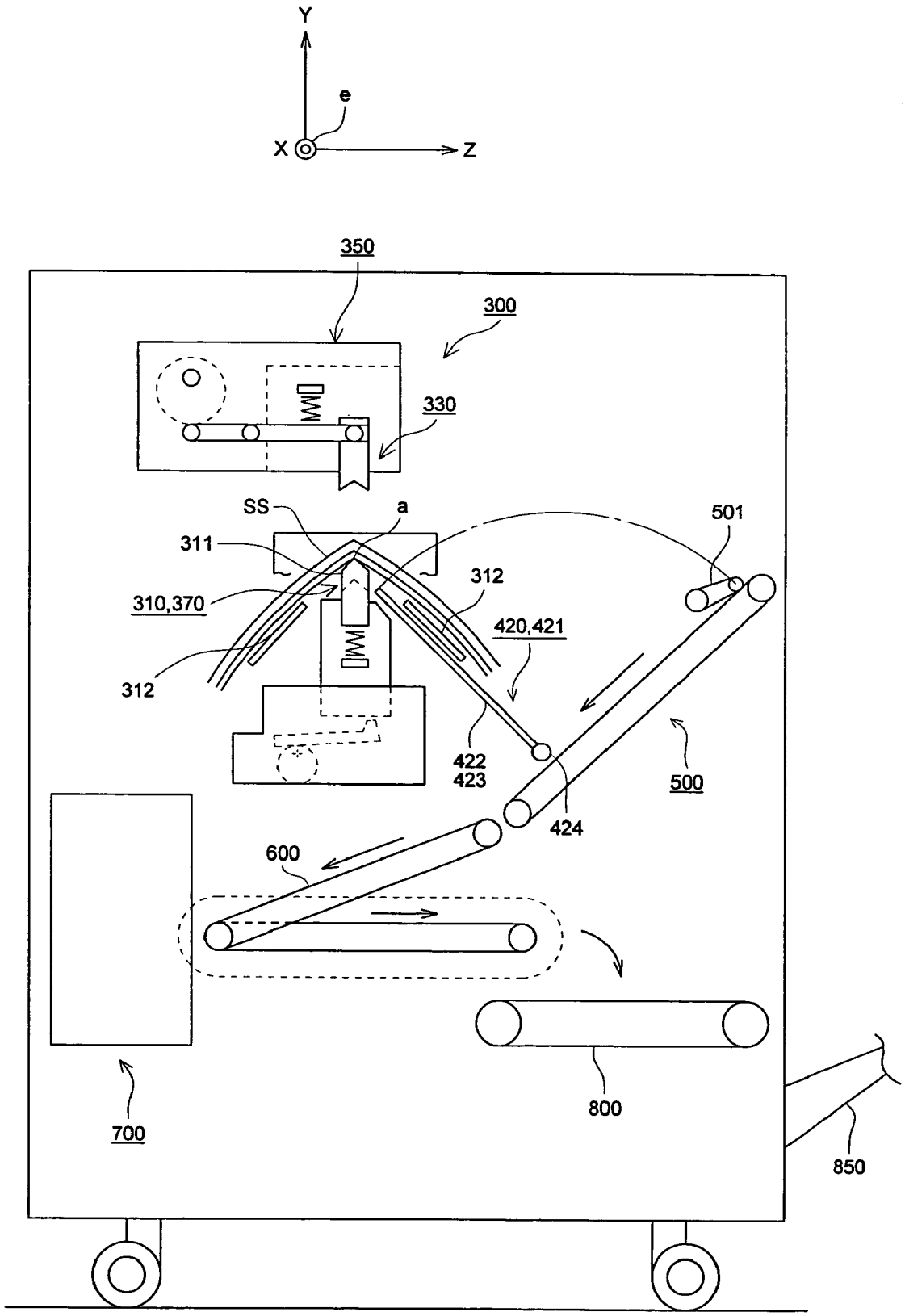
FIG. 4 is the left side view of the sheet finishing apparatus of FIG. 2.
Figure 5:
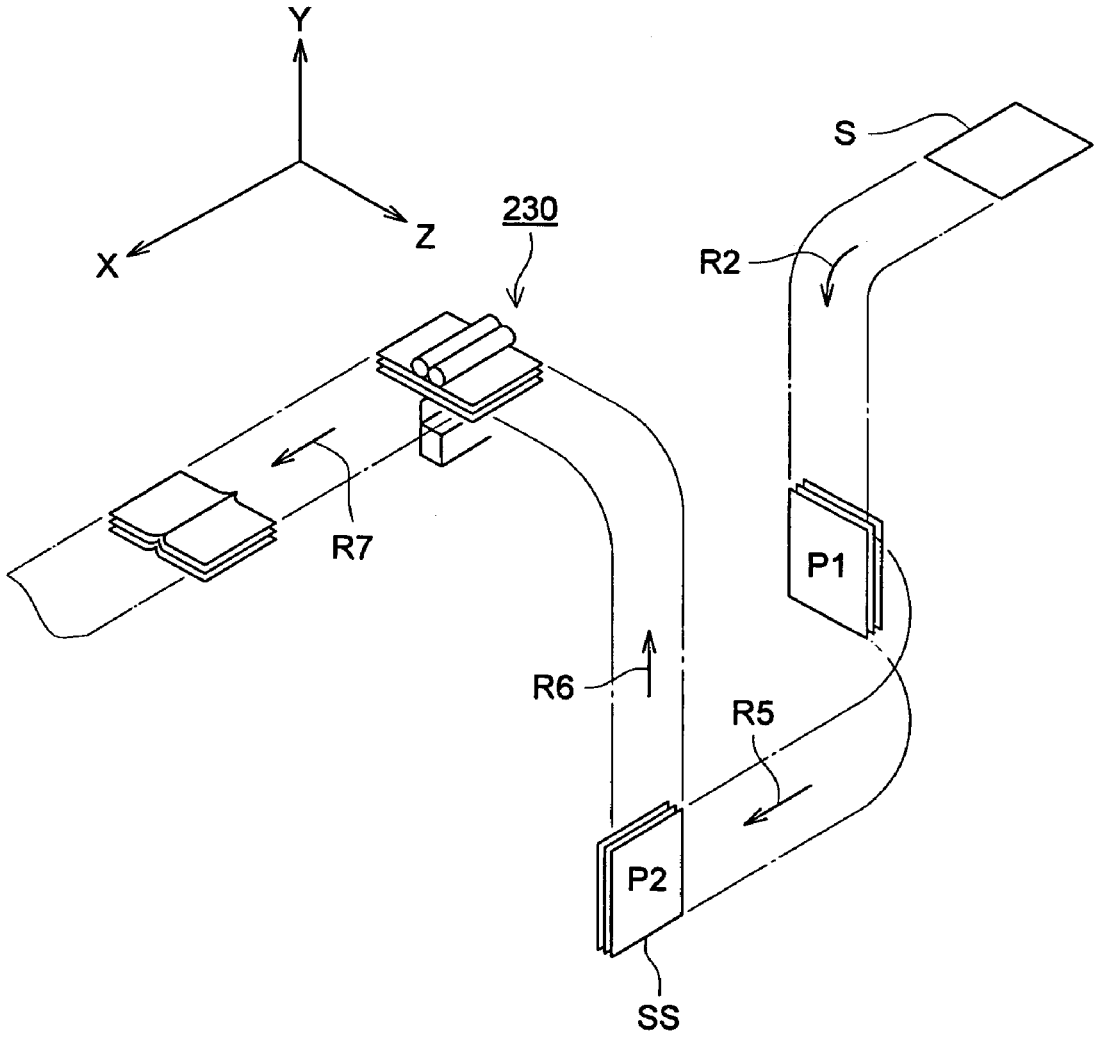
FIG. 5 is a schematic diagram showing a part of the flow of paper sheets in a sheet finishing apparatus.

FIG. 2 is an outline front view diagram of a sheet finishing apparatus, FIG. 3 is the right side view, FIG. 4 is the left side view, and FIG. 5 is a schematic diagram showing a part of the flow of paper sheets in a sheet finishing apparatus.

In each of these diagrams the arrows X, Y, and Z indicate the directions of the orthogonal coordinate axes, and the positive directions of the coordinate axes are called the X-axis direction, Y-axis direction, and the Z-axis direction, and the negative directions are referred to as the negative X-axis direction, the negative Y-axis direction, and the negative Z-axis direction.

Further, the symbol 'e' denotes the case when the arrow is at right angles to the paper surface and the arrow is pointing towards the surface of the paper, and the symbol 'f' denotes the case when the arrow is pointing towards the back surface of the paper.

The sheet S on which image formation has been done by the image forming apparatus is transported by the transport path selection member at the inlet section of the sheet finishing apparatus B to either the transport path of discharging it as it is without carrying out any other processing on it or to the transport path for carrying out center-folding and center stapling.

The sheet S sent to the transport path for carrying out center-folding and center-stapling is center-folded in the condition in which several of the sheets have been stacked one upon the other, stacked onto a stacker having an inverted V shape, the center-stapling process is carried out on the stack of sheets when a specific number of sheets have been stacked on the stacker, after which the stapled stack of sheets is taken out by the sheet taking out device, and is discharged after the edge of the stack of sheets is cut by the sheet cutting device according to the present invention.

To begin with, the transport path of the sheet S that has entered the transport path R1 is described here with reference to FIG. 2.

The sheet S sent to the transport path R1 by the transport path selection member G1 is transported by being gripped by the transport rollers 203 to 207, and is transported to either the transport path R3 above the transport path selection member G2 or the transport path R4 below the transport path selection member G2.

The sheet S transported to the upper transport path R3 is discharged by the discharge roller 208 to the auxiliary tray (the top tray) 209 placed above the sheet finishing apparatus B.

The sheet S transported to the lower transport path R4 is gripped and transported by the transport rollers 210 to 213 and sent by the discharge roller 214 to other sheet finishing apparatus and others.

Next, the transportation of the sheet S that has entered the transport path R2 is described here with reference to FIG. 2 and FIG. 5.

The sheet S that has entered the transport path R2 by the transport path selection member G1 is transported in the negative Y-axis direction and is temporarily stopped and stored at a specific position (the position P1 shown in the drawing).

At the position P1, a small number of succeeding sheets of paper S are superposed and stored.

Although this number of sheets stored at this point is three in the present preferred embodiment, the number of sheets stored need not be restricted to this and can be set appropriately.

After the three sheets S stored at the position P1 are transported in the Z-axis direction in the stacked condition by the transport roller 215, transport roller 216, and guide plates (not shown in the drawing), etc., their direction is changed to the X-axis direction and they are temporarily stopped and stored (transport path R5).

Further, in the following description, a plurality of stacked sheets is referred to as a sheet bundle SS, unless stated otherwise.

The sheet bundle SS that has temporarily stopped at the position P2 is first transported in the Y-axis direction at a specific timing by the transport roller 217, transport roller 218, and guide plates, etc., and thereafter its direction is changed to the negative Z-axis direction (transport path R6).

The sheet bundle SS whose direction is changed to the negative Z-axis direction is transported to the center-folding device 230 by the transportation aligning belt 220.

Here, the center-folding device 230 is described while referring to FIG. 3.

In the present preferred embodiment, the configuration is such that the direction of the longer side of the sheet bundle SS is the same as the transportation direction of the transportation aligning belt 220.

The center-folding device 230 is constituted by the aligning member 232, the center-folding rollers 234 and 235, and the center-folding knife 236, etc.

The aligning member 232 is placed at a position that is away from the contact point between the center-folding rollers 234 and 235 by a distance equal to half the length of the sheet bundle SS in its longitudinal direction.

The sheet bundle SS transported in the negative Z-axis direction is transported above the guide plate 251 constituting the center-folded sheet transporting mechanism 250 to be described later while being pressed by the aligning claw 221 provided in the transportation aligning belt 250, and stops at the position at which the leading edge of the sheet bundle SS pushes against the aligning member 232.

Next, the aligning claw carries out forward and reverse movement due to the forward and reverse rotation of the transportation alignment belt 220 thereby pushing the rear edge of the sheet bundle SS (with 3 sheets) and thus aligning their widths in the transportation direction.

After the above alignment operation is completed, the center-folding knife 236 provided below the contact point between the center-folding rollers 234 and 235 pushes up the middle part along the longitudinal direction of the sheet bundle SS above the guide plate 251, and makes the sheet bundle SS get squeezed between the center-folding rollers 234 and 235 that are rotating in the direction of the arrow shown in the drawing.

After a folding line has been formed at the middle of the longitudinal direction of the squeezed sheet bundle SS by the center-folding rollers 234 and 235, it is returned to above the guide plate 251 due to the reverse rotation of the center-folding rollers 234 and 235, and is transported in the X-axis direction by the center-folded sheet transportation mechanism 250 to be described later.

The configuration is such that the position of the aligning plate 232, the operation of the transportation aligning belt 220, etc., are changed according to the sheet size by a controller not shown in the drawing when the sheet size has been changed.

Further, it is also possible to triple fold the sheet bundle SS in a Z-shaped manner using the roller 237 and the folding knife 238, etc.

Coming back to FIG. 2 and FIG. 5, the sheet bundle SS in which a folding line has been formed at the center of the longitudinal direction is transported in the X-axis direction by the transportation tab 252 provided in the transportation belt of the sheet transporting mechanism 250 and by the guide plate, etc., not shown in the drawing, and is stacked on the stacker 310 (transport path R7).

Next, the stapler 350 and the staple receiver 370 that constitute the center-stapler, and the stacker 310 are described while referring to FIG. 4.

The stacker 310 is constituted by the inverted V-shaped folding line supporting member 311 and the similarly inverted V-shaped edge supporting member 312, the folding line supporting member 311 supports the neighborhood of the valley side surface (the lower surface) folding line a of the sheet bundle SS in which a folding line has been formed, and the edge supporting member 312 supports the edge part of the valley side surface of the sheet bundle SS in which a folding line has been formed.

Here, the expression "valley side surface of the sheet bundle SS in which a folding line has been formed" refers to the two opposing inside surfaces of the sheet when the sheet is folded along the folding line, and the outside surface of the sheet in this condition is referred to as the ridge side surface.

A pressing member 330 capable of being moved in the up and down directions and the fixed stapler 350 are placed above the stacker 310.

The staple receiver 370 capable of being moved in the up and down directions is placed below the folding line 'a' of the sheet bundle SS that has been stacked.

The stapler 350 and the staple receiver 370 constituting the sheet stitching mechanism are placed at two equidistant locations from the center along the sheet folding direction.

Because of the above configuration, when the number of sheets in the sheet bundle SS stacked in the stacker 310 reaches a specific number, with the pressing member 330 in the condition of having come down and pressing the sheet bundle SS, the staple receiver 370 rises and the staple wire from the stapler 350 is stapled at two locations in the folding line of the sheet bundle SS.

Next, the taking out of the center-stapled sheet bundle SS is described referring to FIG. 2 and FIG. 4.

The sheet taking out mechanism 420 that takes out the sheet bundle SS is configured using the supporting member 421, a driving source (with no reference symbol), etc.

The supporting member 421 has the supporting members 422 and 423 placed at the two ends of the sheet bundle SS stacked on the stacker 310, and these supporting members 422 and 423 are formed using bar-shaped materials whose one end is bent at right angles for supporting the folding line of the sheet bundle SS thereby forming the bent parts 422A and 423A.

The other ends of the supporting members 422 and 423 are supported so that they can rotate freely around the supporting shaft 424.

The supporting members 422 and 423 are configured so that they can be inserted and removed by the driving source at the folding section of the sheet bundle SS for supporting the sheet bundle SS that has been stacked as seen from the left-right direction in FIG. 2.

Further, the supporting members 422 and 423, as shown in FIG. 4, swing with the supporting shaft 424 at the center being driven by the driving source between the position of taking out the sheet bundle SS stacked on the stacker 310 and the hand over position of receiving the sheet bundle SS and stacking it on the conveyor 310.

Because of this configuration, when the number of sheets in the sheet bundle SS stacked on the stacker 310 reaches a specific number and the center-stapling operation by the center-stapler is completed, and after the supporting members 422 and 423 are inserted in the neighborhood of the folding line of the sheet thereby supporting the folding line section of the sheet bundle SS, the supporting members 422 and 423 are rotated from the take out position to the hand over position and placed on the receiving conveyor 500, and interpose the stacked sheet bundle SS using the grips 501.

The sheet bundle SS interposed by the grips 501 are transported in the obliquely downward direction linked with the rotation of the receiving conveyor 500, and after being released by the grips 501, they are handed over to the cutting conveyor 600.

The cutting conveyor 600 goes into the horizontal state after the sheet bundle SS is handed over, and subsequently, the sheet bundle SS is transported towards the sheet cutting device 700 and stops at a specific location while being in the condition in which its folding line part is pressed by the folding line pressing member to be described later, and the edges of the paper sheets that are not aligned with each other (the free edge on the side opposite to the folding line) are cut by the sheet cutting device according to the present invention thereby aligning the edges of the sheets.

When the cutting operation is completed, the sheet bundle SS is transported in the reverse direction by the cutting conveyor 600, drops down in the direction of the arrow from the leading edge of the cutting conveyor and is collected by the collection conveyor 800, and is then discharged to the document discharge tray 850 placed on the outside of the front panel of the sheet finishing apparatus B.

Next, the sheet cutting device 700 according to the present invention are detailed below referring to FIG. 6(*a*) to FIG. 8.

Figure 6:
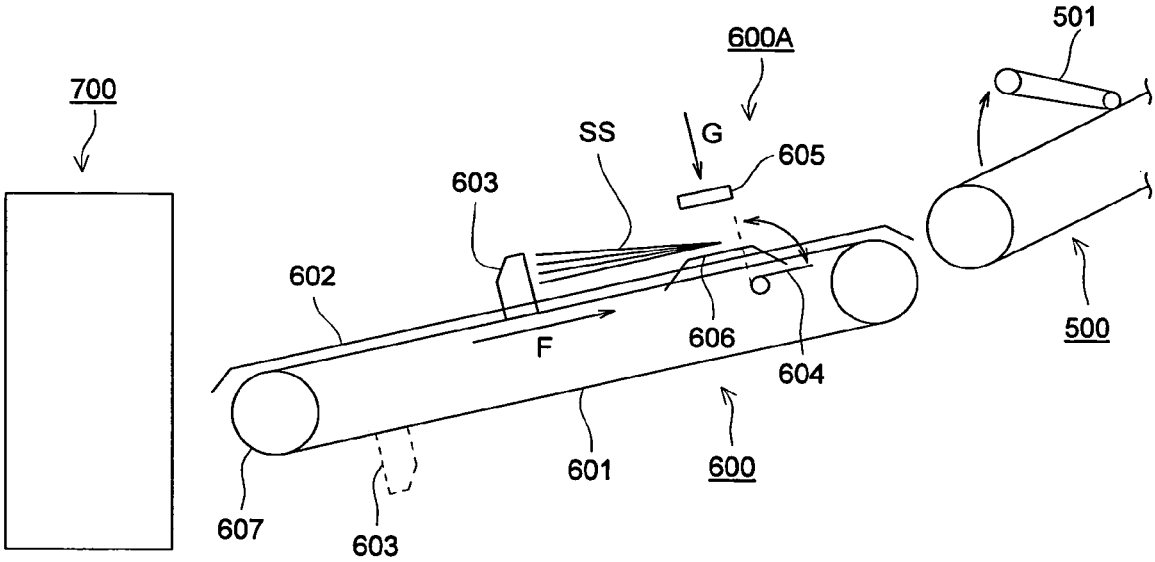
FIGS. 6(*a*) and 6(*b*) are a schematic diagram of the transport mechanism of the cutting conveyor 600 and of the sheet bundle SS.
Figure 6:
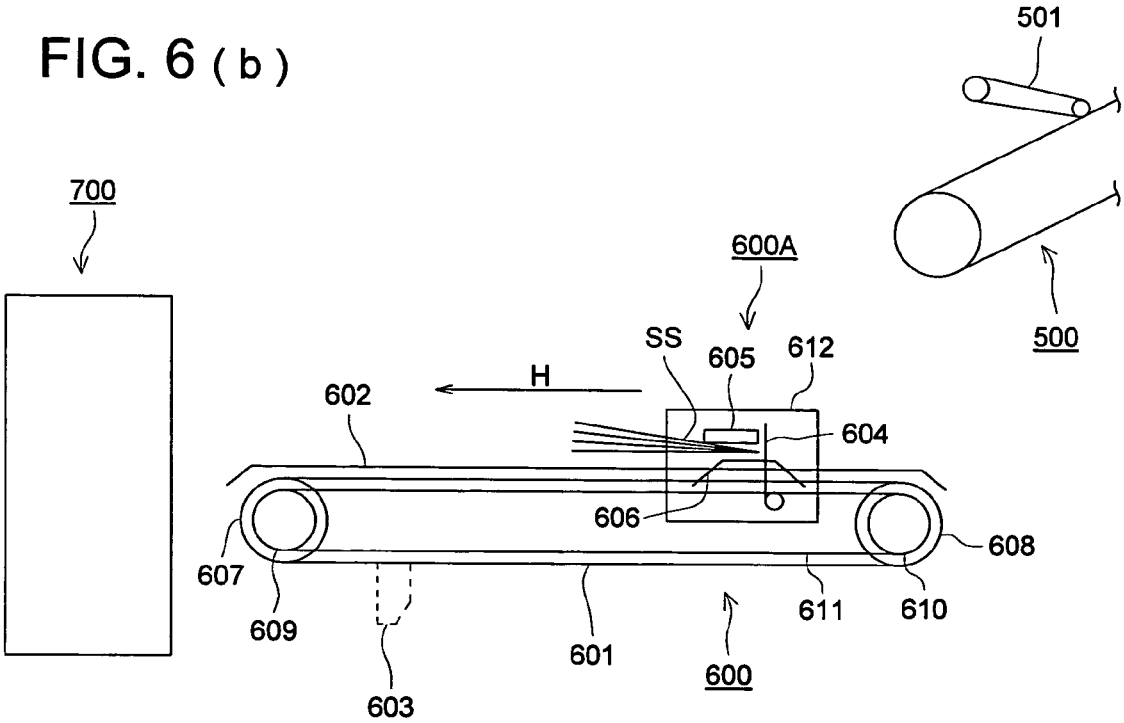

FIGS. 6(*a*) and 6(*b*) are a schematic diagram showing the transport mechanism of the cutting conveyor 600 and of the sheet bundle SS, respectively.

Figure 7:
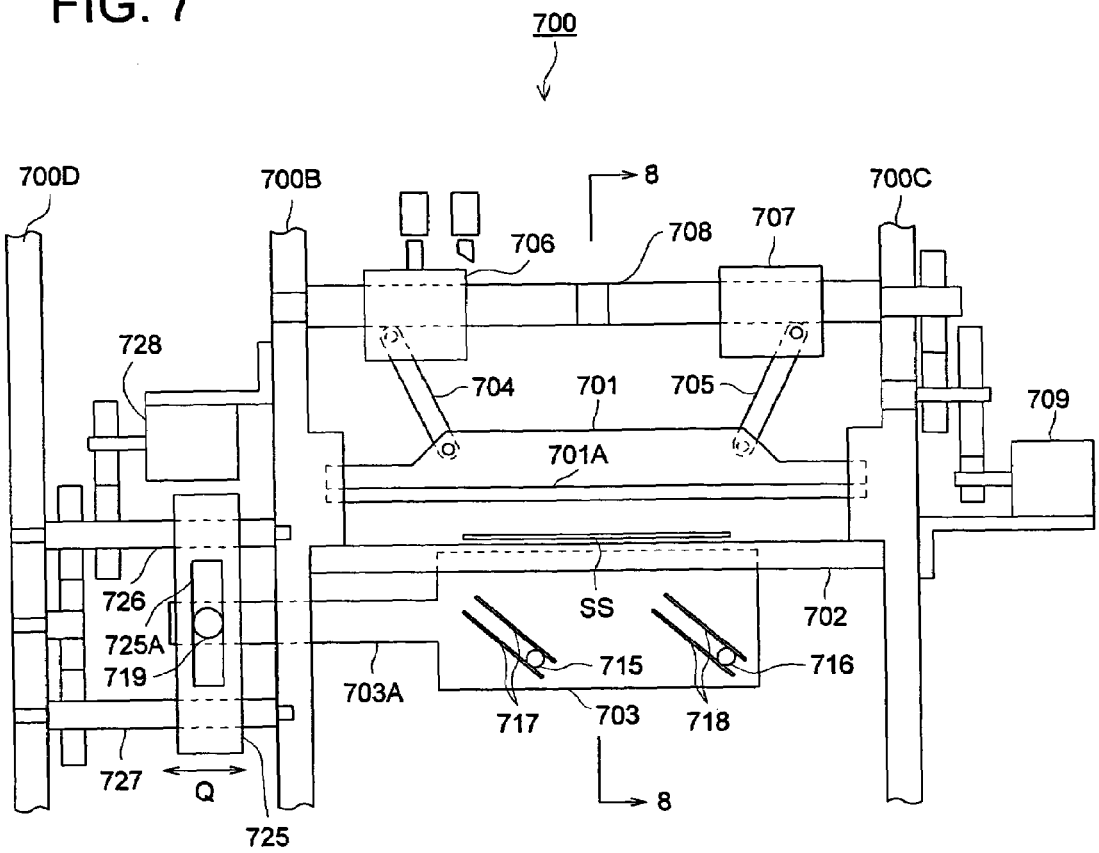
FIG. 7 is an outline front view of the sheet cutting device 700 as viewed from the sheet insertion direction.

FIG. 7 is an outline front view of the sheet cutting device 700 as viewed from the sheet insertion direction. FIG. 8 is a cross-sectional view diagram along the section 8-8 in FIG. 7 showing the important parts.

To begin with, using FIGS. 6(*a*) and 6(*b*), the mechanism is described here for handing over the center-folded and center-stapled sheet bundle SS from the receiving conveyor 500 to the cutting conveyor 600 and then making it stop at a specific position after that handing over for cutting the edge in the sheet cutting device 700.

As is shown in FIG. 6(*a*), the grip 501 near the end point in the downstream side of the sheet transport direction of the receiving conveyor 500, thereby releasing the interposed sheet bundle SS.

The released sheet bundle SS comes near the belt above the transporting belt 601 that has been stopped in the inclined position and passes over the pulleys 607 and 608, slides over the top inclined surface of the sheet stacking table 602 provided in parallel, and comes to a stop alter coming into contact with a stopper claw 603 fixed to the transporting belt 601.

After the sheet bundle SS stops, the aligning member 604 rotates from the position shown by the solid line to the position shown by the dotted line in the drawing.

After the aligning member 604 rotates, the transporting belt 601 moves in the direction shown by the arrow F in the drawing, and stops after the folding line section of the sheet bundle SS is made to come into contact with the aligning member 604 by the stopper claw 603.

In this manner, the skew of the sheet in the transportation direction is corrected by making the sheet bundle SS come into contact with the aligning member 604.

After the stopper claw 603 stops, the folding line pressing member 605 moves down in the direction of the arrow G shown in the drawing, and interposes the sheet bundle SS between the receiving plate 606 provided to have almost the same horizontal plane as the sheet stacking table 602.

When the interposing of the sheet bundle SS is completed, the cutting conveyor 600 rotates and the stopper claw 603 recedes to the position indicated by the dotted line in the drawing.

After the stopper claw 603 has receded completely, the aligning member 604, the folding line pressing member 605, and the receiving plate 606 rotate rotating around the center of the pulley 607 of the cutting conveyor 600 up to and stop at the horizontal position shown in FIG. 6(*b*) together with the cutting conveyor 600 while continuing to interpose the sheet bundle SS.

When the rotation of the cutting conveyor 600 is completed, while the side of the sheet bundle SS that becomes the finished product is being interposed by the folding line pressing member 605 and the receiving plate 606, the sheet bundle SS is moved in the direction of the arrow H in the drawing by the inserting device 600A while sliding above the sheet stacking table 602, is inserted into the cutting section of the sheet cutting device 700, and comes to a stop at a specific position determined depending on each sheet size.

Further, the inserting device 600A is constituted by the insertion belt 611 passed over the pulleys 609 and 610 having the same axis of rotation as the pulleys 607 and 608, the moving body 612 fixed to the insertion belt 611 and holding the aligning member 604, the folding line pressing member 605, and the receiving plate 606, and, the insertion motor (not shown in the drawing) which rotates the insertion belt 611 in the forward and reverse directions, etc., and this inserting device 600A rotates along with the cutting conveyor 600 with the center of the pulley 607 as a fulcrum.

The sheet bundle SS stops at a specific position by the inserting device 600A, has its edge cut by the sheet cutting device 700. The sheet cutting device 700 is detailed here referring to FIG. 7 and FIG. 8.

Here, 701 is the sheet pressing member that is free to move in the up-down direction, 701A is the blade receiving member provided integrally with the sheet pressing member 701 on its surface facing the sheet bundle SS, 702 is the sheet receiving member fixed to the side surfaces 700B and 700C of the body of the sheet cutting device 700, and 703 is the cutting blade (lower blade) free to move in the up-down direction.

As is shown in the drawing, the blade receiving member 701A is placed at the position of receiving the lower cutting blade 703 through the sheet bundle SS.

Further, 704 and 705 are coupling rods whose one end is connected near the two ends of the sheet pressing member 701 and their other ends are rotatably connected to the female screw units 706 and 707, respectively, as is shown in FIG. 7.

The female screw units 706 and 707 engage with the ball screw 708 having male threads in mutually opposite directions.

The ball screw 708 is supported in a free to rotate manner by the side plates 700B and 700C of the sheet cutting device 700, and the rotation of the sheet pressing motor 709 capable of forward and reverse rotations is transmitted to the ball screw 708 via a plurality of gear wheels (with no reference symbols).

Therefore, the sheet pressing member 701 moves in the up-down direction due to the forward and reverse rotation of the sheet pressing motor 709.

Further, the plurality of gear wheels mentioned above have been constituted so as to transmit the rotations of the sheet pressing motor 709 to the ball screw 708 after speed reduction.

Because of this configuration, a large torque is generated even when the motor capacity of the sheet pressing motor 709 is small, the sheet bundle SS is interposed with a large force by the blade receiving member 701A and the sheet receiving member 702, thereby making it possible to prevent slipping of the sheets during the cutting process.

Two free to rotate rollers 715 and 716 are mounted on the lower cutting blade 703, and engage slidably with the guiding members 717 and 718 which are fixed to the main body (no reference number) of the sheet cutting device 700.

The sliding parts of the guiding members 717 and 718 have been formed in the direction towards the top left of FIG. 7.

The lower cutting blade 703 has the coupling part 703A, and the roller 719 is rotatably mounted at the tip of the coupling part 703A.

As is shown in FIG. 7, the roller 719 is slidably engaging with the guide groove 725A formed in the up-down direction in the lower cutting blade driving member 725.

The lower cutting blade driving member 725 has a threaded part that engages with the ball screws 726 and 727, and the ball screws 726 and 727 are supported in a free to rotate manner by the side plates 700B and 700D of the body, and the rotations of the lower cutting blade driving motor 728 capable of forward and reverse rotation are transmitted via a plurality of gear wheels (with no reference numbers) to these ball screws so that the directions of their rotations are identical.

The ball screws 726 and 727 both rotate in the forward or reverse direction due to the forward or reverse rotation of the lower cutting blade driving motor 728, and the lower cutting blade driving member 725 carries out reciprocating movement in the direction of the arrow Q shown in FIG. 7.

As a result, the rollers 715 and 716 move along the sliding parts of the guiding members 717 and 718, and the lower cutting blade 703 moves in a linear direction along this sliding section, that is, from the top left to the bottom right direction or vice versa as is shown in FIG. 7.

Here, 750 (see FIG. 8) is an airflow generating device which is a feature of the present invention and sends an airflow between the blade receiving member 701A and the sheet receiving member 702 and has the function of blowing off cutting shreds generated after cutting and collecting them in the cutting shred collection box 729.

The airflow generating device 750 is constituted by the fan 751 which is the airflow generating source, the nozzle 752 for sending the airflow between the blade receiving member 701A and the sheet receiving member 702, and the fan driving motor (not shown in the drawing). Further, the airflow generating device 750, as is shown in the drawing, is provided on the upstream side as seen from the cutting position SP at which the lower cutting blade 703 cuts the sheet bundle towards the direction of insertion of the sheet bundle. In other words, the airflow generating device 750 is provided on the downstream side than the cutting position SP relative to the direction of taking out the sheet bundle after cutting from the cutting position SP.

Figure 8:
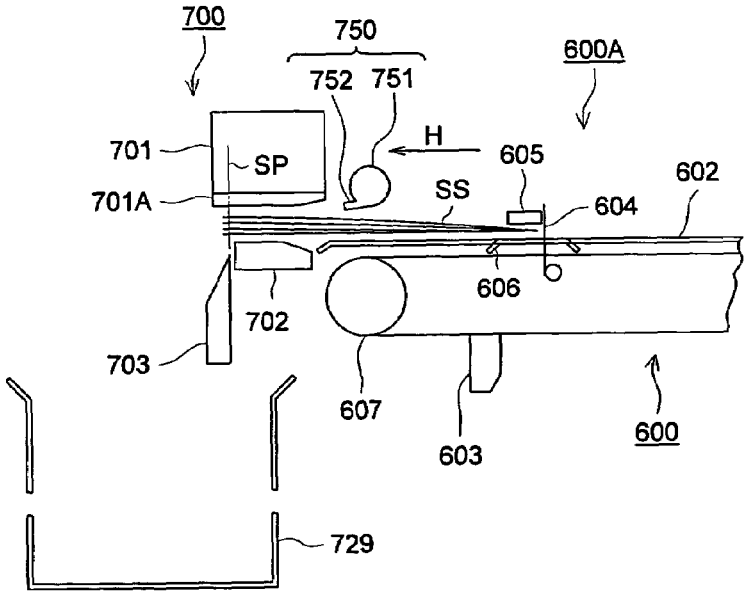
FIG. 8 is a cross-sectional view diagram showing the important parts along the section 8-8 in FIG. 7.

The cutting position SP corresponds to the surface formed by the movement of the tip of the lower cutting blade 703 indicated by the dot-and-dash line shown in FIG. 8. The airflow generated by the airflow generating device 750 is sent towards the cutting position SP from the product side of the sheet bundle SS, that is, the upstream side as seen from the sheet bundle insertion direction relative to the cutting position SP (in other words, towards the downstream side of the cutting position SP relative to the sheet bundle taking out direction). In this manner, by sending the airflow from the upstream side of the cutting position SP relative to the sheet bundle insertion direction, in other words, from the downstream side of the cutting position SP relative to the sheet bundle taking out direction, it is possible to prevent the entrance of cutting shreds into the downstream side from the cutting position towards the sheet bundle taking out direction.

The airflow generating device 750 is controlled by the controller (not shown) of the sheet finishing apparatus B (see FIG. 1) so that the airflow generation is stopped during the period when the inserting device 600A is inserting the sheet bundle SS between the blade receiving member 701A and the sheet receiving member 702. By carrying out control in this manner, at the time of feeding the sheet bundle SS, it is possible to prevent the sheet bundle from flapping due to the airflow. Therefore, it is possible to prevent the leading edge of the sheet bundle from getting stuck at the inlet section of the blade receiving member 701A and the sheet receiving member 702, and to prevent a part of the sheet bundle from getting folded.

Figure 9:
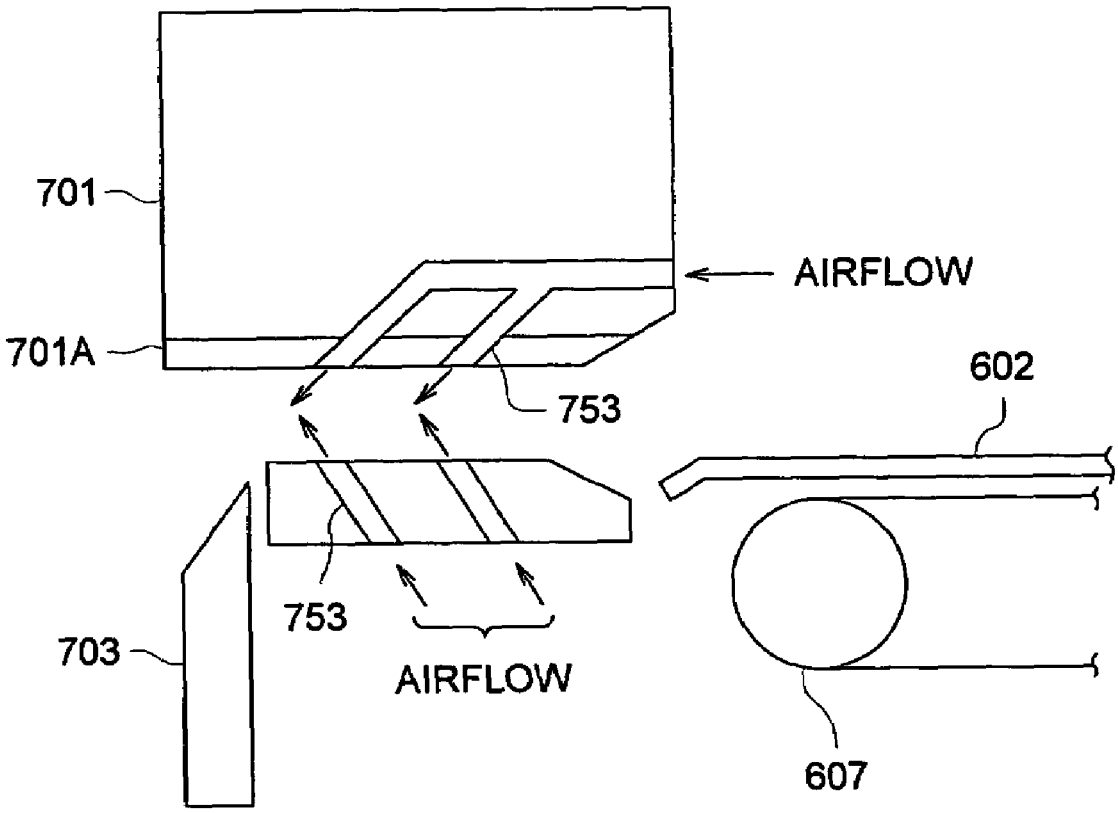
FIG. 9 is a cross-sectional view diagram of the neighborhood of the cutter receiving member and the sheet receiving member showing another preferred embodiment of the airflow generating device.

Further, in the present preferred embodiment, the airflow generating device 750 is provided at the inlet section of the blade receiving member 701A and the sheet receiving member 702. However, it is not necessary to restrict the present invention to this configuration, but it is possible to have a configuration in which the airflow is sent from the upstream side of the cutting position SP relative to the sheet bundle insertion direction, in other words, from the downstream side of the cutting position SP relative to the sheet bundle taking out direction. Therefore, for example, as is shown in FIG. 9, it is possible to provide airflow holes 753 in the blade receiving member 701A and the sheet receiving member 702, thereby having a configuration in which airflow is blown from the airflow holes 753.

Such a configuration offers the advantage that it is possible to remove the cutting shreds definitely because the airflow is blown directly from the blade receiving member 701A and the sheet receiving member 702.

Next, the operation of inserting sheet bundle SS into the cutting section, the operation of the sheet cutting device 700, and the operation of taking out sheet bundle SS in the configuration described above are explained below using mainly FIG. 8.

The center-folded and center-stapled sheet bundle SS is moved in the direction of the arrow H in FIG. 8 by sliding over the sheet stacking table 602 while being interposed by the folding line pressing member 605 and the receiving plate 606, and is inserted into the sheet cutting section having the blade receiving member 701A, the sheet receiving member 702, the lower cutting blade 703, etc., and comes to a stop at a specific position determined depending on each sheet size.

When the sheet bundle SS stops, the sheet pressing motor 709 (see FIG. 7) rotates, the sheet pressing member 701 comes down, and the sheet bundle SS is interposed near the edge on the finished product side by the blade receiving member 701A and the sheet receiving member 702.

When the sheet bundle SS is interposed, the lower cutting blade driving motor 728 (see FIG. 7) rotates, the lower cutting blade 703 moves up diagonally from bottom right to top left, while cutting the sheet bundle SS until its tip enters very slightly into the blade receiving member 701A, thereby carrying out the edge cutting operation of the sheet bundle SS.

When the edge cutting operation is completed, the lower cutting blade driving motor 728 rotates in the reverse direction and the lower cutting blade 703 moves down to its prescribed position at the bottom right in FIG. 7.

The sheet pressing member 701 moves up to its prescribed position when the downward movement of the lower cutting blade 703 has been completed.

When the sheet pressing member 701 starts moving upward, the airflow generating device 750 operates to send airflow between the blade receiving member 701A and the sheet receiving member 702, and cutting shreds that have got adhered to the blade receiving member 701A or to the sheet receiving member 702 due to static electricity are blown off and fall into the cutting shred collection box 729.

After the upward movement of the sheet pressing member 701 has been completed, not only the operation of the airflow generating device 750 stops, but also the folding line pressing member 605 and the receiving plate 606 that had been interposing the sheet bundle SS near the folding line section return to the positions shown in FIG. 6(*b*), the folding line pressing member rises and the aligning member 604 recedes to below the sheet transporting surface thereby releasing the interposing of the sheet bundle SS.

Next, the cutting conveyor 600 rotates, the sheet bundle SS whose edge is cut to finish it as a product is dropped down, due to the stopper claw 603, and as is shown in FIG. 4, in the direction of the arrow from the leading edge of the cutting conveyor 600 and is transported by the rotating collection conveyor 800, and is then discharged to the discharge tray 850 placed on the outside of the front panel of the sheet finishing apparatus B.

However, in the present preferred embodiment, although control is being carried out so that the airflow generating device 750 starts operation along with the upward movement of the sheet pressing member 701 and stops operating at the instant of time when the upward movement of the sheet pressing member 701 is completed, it is not necessary to restrict the present invention to this, and it is possible to generate the airflow by keeping the airflow generating device 750 in the operating state during time intervals other than the timing when the sheet bundle SS is inserted between the lower cutting blade receiving member 701A and the sheet receiving member 702 by the inserting device 600A. Generating the airflow for long durations in this manner has the advantage that it is possible to remove the cutting shreds definitely.

Further, it is also possible to generate the airflow by operating the airflow generating device 750 after the sheet bundle SS is inserted between the lower cutting blade receiving member 701A and the sheet receiving member 702 by the inserting device 600A, the sheet pressing member 701 is lowered by the sheet pressing motor 709, and the sheet bundle SS is interposed by the lower cutting blade receiving member 701A and the sheet receiving member 702. Further, it is possible to stop temporarily the operation of the airflow generating device 750 until just before the subsequent sheet bundle SS is inserted.

In addition, the sheet finishing apparatus B according to the present preferred embodiment has a configuration in which after the sheet bundle is inserted to the cutting position and the cutting operation is carried out, it is taken out in a direction opposite to that of the insertion direction. However, the present invention need not be restricted to this configuration but it is possible to have a configuration of the sheet finishing apparatus in which the direction of inserting the sheet bundle is the same as the direction of taking it out. When these two directions are identical, the sheet bundles are stopped temporarily after the major portion of the sheets other than the parts to be cut and discarded has passed over the cutting position, and the sheet bundle is discharged by sending it in the same direction as the insertion direction after its edge has been cut. The configuration is made such that the airflow generating device is positioned on the downstream side of the sheet cutting position relative to the sheet bundle taking out direction, thereby sending the airflow from the downstream side towards the cutting position. The cutting shred collection box is positioned on the upstream side relative to the sheet bundle taking out direction, and is positioned so that the cutting shreds blown off by the airflow is collected therein. In such an apparatus, it is possible to have a structure in which the device for inserting the sheet bundle up to the cutting position and the device for taking out the sheet bundle after cutting operation from the cutting position are configured using the same device or using different devices.

As has been explained above, by providing the airflow generating device for removing cutting shreds on the upstream side of the cutting position SP relative to the sheet bundle insertion direction, in other words, from the downstream side of the cutting position SP relative to the sheet bundle taking out direction, it is possible to remove the cutting shreds by blowing them off and to prevent the paper shreds generated at the time of cutting from getting adhered to the table or to the paper pressing member without falling down because of the static electricity generated while carrying out the different processes of punching, stapling, folding, etc., or because of the static electricity generated due to the friction between the table and sheet pressing member at the time of insertion into the cutting section, or because of the static electricity generated at the time of cutting.

As a consequence, because carrying out the cutting operation with the paper shreds adhering to the table or to the paper pressing member is not present, it is possible to prevent the cutting shreds from leaving their marks on the stack of sheets because the force of pressing the stack of sheets is large thereby deteriorating the finishing quality. And to prevent the outer sheets in a stack of sheets from getting slightly shifted or from getting folded because of the presence of adhered paper shreds when a new stack of sheets is inserted into the cutting section.

Further, by providing a sheet cutting device with a high reliability as explained above in a sheet finishing apparatus or an image forming system, the apparatus or the system becomes one of high quality and high functionality.

What is claimed is:

1. A sheet cutting apparatus comprising:

(a) a cutting blade for cutting a sheet;

(b) a blade receiving member for receiving a cutting edge of the cutting blade;

(c) a sheet receiving member provided opposite to the blade receiving member for interposing an edge of the sheet therebetween;

(d) a taking out device for taking out the sheet from the cutting position after the sheet has been cut by the cutting blade; and (e) an airflow generating device provided downstream of the cutting position in a direction of taking out the sheet by the taking out device for supplying an airflow to the blade receiving member and the sheet receiving member at the cutting position.

2. The sheet cutting apparatus of claim 1, further comprising a controller which controls the airflow generating device to stop supplying the airflow when the sheet is inserted to the cutting position.

3. The sheet cutting apparatus of claim 1, further comprising a collection box for storing cutting shreds of a plurality of sheets which have been cut by the cutting blade, the collection box provided on an opposite side and downward of the airflow generating device with respect to the cutting position.

4. The sheet cutting apparatus of claim 1, wherein an inserting direction of the sheet to the cutting position and a taking out direction of the sheet from the cutting position are opposite to each other.

5. A sheet finishing apparatus for finishing a sheet received from an outside, comprising the sheet cutting apparatus described in claim 1 for cutting a sheet that the sheet finishing apparatus has received.

6. An image forming system comprising:

(a) an image forming apparatus for recording an image on a recording sheet; and (b) the sheet cutting apparatus described in claim 1 for cutting the recording sheet on which the image has been recorded by the image forming apparatus.

7. The sheet cutting apparatus of claim 1, further comprising a lower cutting blade driving member which moves up the cutting blade to cut the sheet.

8. The sheet cutting apparatus of claim 1, further comprising a motor which enables the taking out device to insert and take out the sheet to and from the cutting position thereof.

* * * * *